United States Patent [19]

Chen

[11] Patent Number: 5,069,050

[45] Date of Patent: Dec. 3, 1991

[54] KEY HOLDER ASSEMBLY WITH SEPARABLE STRAPS OF COMPLEMENTARY HOOK AND LOOP FASTENING MATERIALS

[75] Inventor: Nathan Chen, Huntingbeach, Calif.

[73] Assignee: Perfect Fastener, Inc., Huntington Beach, Calif.

[21] Appl. No.: 694,432

[22] Filed: May 1, 1991

[51] Int. Cl.[5] ..... A47G 29/10

[52] U.S. Cl. ..... 70/456 R; 24/3 K; 206/37.1; 206/37.7; 206/37.8

[58] Field of Search ..... 70/456 R, 456 B, 457, 70/458, 459, 460; 24/3 K; 206/37.1, 37.3, 37.5, 37.4, 37.7, 37.8; D3/61, 62, 65

[56] References Cited

U.S. PATENT DOCUMENTS

D. 307,671 5/1990 Satterly ..... D3/61

4,705,086 11/1987 O'Neill ..... 206/37.4 X 4,799,587 1/1989 Desanto ..... 206/37.8 X 4,907,694 3/1990 Miller et al. ..... 206/37.1 X 4,964,508 10/1990 Balsley ..... 206/37.1

*Primary Examiner*—Lloyd A. Gall

*Attorney, Agent, or Firm*—John R. Flanagan

[57] ABSTRACT

A separable key holder assembly includes a pair of key rings, a pair of flexible mounting straps, and a pair of patches of complementary hook and loop fastening materials detachably attachable together and applied on the respective straps. Each strap has an end portion being folded around one of the key rings and back upon itself so as to provide overlapped sections on the end portion of strap. The overlapped sections of the strap contain a heat sealed zone in which they are permanently attached to one another. Each patch extends over substantially the entire length and width of one of the opposite surfaces of the respective straps.

11 Claims, 2 Drawing Sheets

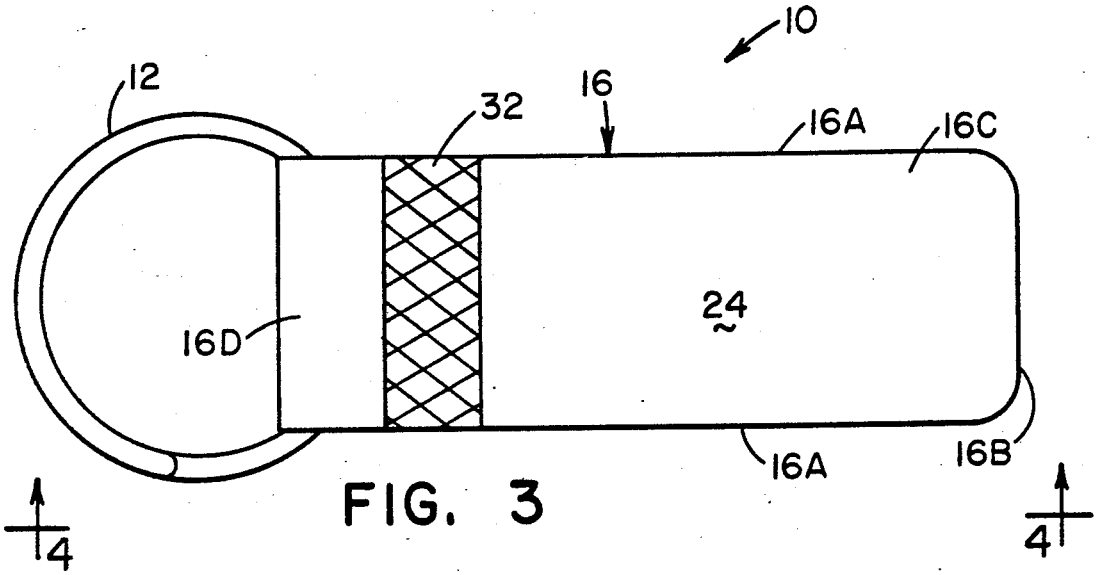
FIG. 3
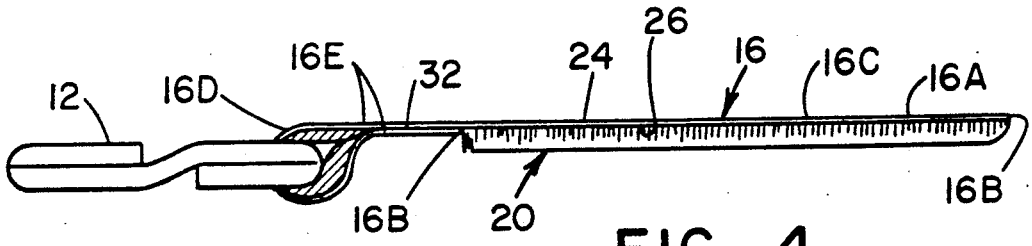
FIG. 4
FIG. 5
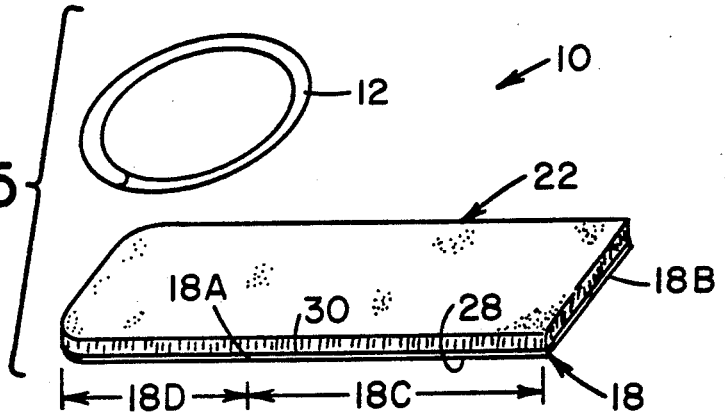

KEY HOLDER ASSEMBLY WITH SEPARABLE STRAPS OF COMPLEMENTARY HOOK AND LOOP FASTENING MATERIALS

BACKGROUND OF THE INVENTION

1. Field of the Invention

The present invention generally relates to key holder assemblies with separable parts and, more particularly, is concerned with a separable key holder assembly composed of separable straps of complementary hook and loop fastening materials.

2. Description of the Prior Art

In the prior patent art, a wide variety of key holder assemblies have been proposed in which two key-holding parts are normally secured together to provide a unitary holder, but are separable to detach one key-holding part from the other for separate uses. For example, the one part might hold car keys and the other part hold house keys. The two parts of the holder assembly may be separated to permit the one part with the car keys to remain with an attendant of a parking lot, while the driver retains the other part with the house keys.

Representative examples of these prior art key holder assemblies are disclosed in U.S. Pat. No. 3,863,477 (Klein), U.S. Pat. No. 4,248,071 (Kussoy), U.S. Pat. No. 4,516,418 (Cuttler), U.S. Pat. No. 4,581,910 (Brooks, et al), U.S. Pat. No. 4,713,951 (Ros) and U.S. Pat. No. 4,881,636 (Oletzke). Of these examples, the Klein key holder assembly appears to have a distinct advantage in terms of simplicity of construction over the others.

The Klein key holder assembly is composed of a pair of holder members. Each holder member includes an elongated strip of material having a tab extending from one end and folded upon itself to form a loop receiving a key ring. The tab is secured in the looped configuration by a rivet which also has a first fastening element of a snap fastener in the form of an outwardly projecting button. A second fastening element of a snap fastener in the form of a socket which is matable with the button of the first fastening element is secured to the opposite end of the holder member. The one holder member thus mounts the separate button and socket parts of two snap fasteners which complement and mate with the socket and button parts of the two snap fasteners mounted by the other holder member. The two holder members can be detachably attached together by mating the respective button and socket parts of the two snap fasteners together which positions the key rings at the opposite ends of the key holder assembly.

Notwithstanding the advantage of the construction of the Klein key holder assembly over the other ones, it still embodies certain shortcomings which make it somewhat less than an optimum construction. One shortcoming of the Klein holder assembly construction is that the two holder members are attached to one another solely at the locations of the two snap fasteners. Holes must be made in the material of the members at these two locations in order to apply the rivets which attach the snap fastener parts to the holder members. Each time the two holder members are pulled apart to unsnap the snap fastener parts from one another, the pulling forces exerted by the user are concentrated at these two locations. Over time there will be a tendency for tears in the material to generate from the holes until the respective snap fasten parts loosen and separate from the holder members.

Another shortcoming of the Klein holder assembly is that the use of the two snap fasteners requires precise alignment of the complementary snap fastener parts of the holder members with one another in order to snap them together. This can be a tedious and time-consuming task which wears on the patience of the user and diverts user's attention from other more important activities.

It is perceived by the inventor herein that further improvements are needed in the design of a separable key holder assembly in order to provide a more durable and user-friendly product.

SUMMARY OF THE INVENTION

The present invention provides a separable key holder assembly designed to satisfy the aforementioned need. The separable key holder assembly of the present invention provides a construction which overcomes the shortcomings of the prior art Klein key holder assembly construction.

The separable key holder assembly of the present invention comprises: (a) a pair of key rings; (b) a pair of mounting parts in the form of straps; and (c) a pair of patches of complementary hook and loop fastening materials on the respective straps being detachably attachable to one another. Unlike the Klein holder assembly, the patches of hook and loop fastening materials do not require that holes be made in the straps in order to mount them to the straps.

Further, the patches of hook and loop fastening materials extend over substantially the entire length and width of facing surfaces of the straps. Unlike the Klein holder assembly, the opposing forces to pull apart the two mounting parts of the holder assembly of the invention are applied along the entire length of the straps in order to cause peeling of the two parts away from one other.

Also, each strap has a main portion and an end portion. The end portion is folded around one of the key rings and back upon itself so as to provide overlapped sections in which the portion of the respective patch on the end portion is covered over. The overlapped strap sections of the end portion of the strap contain a zone in which they are permanently sealed to one another.

The remaining portion of the respective patch on the remaining non-overlapped main portion of the strap is exposed for attachment to the other patch on the other strap. Unlike the Klein holder assembly, the large size of the patches of hook and loop fastening materials permits reattachment of the two mounting parts with one another by sense of feel, facilitating use in dark places and during nighttime, and without the need to actually clearly observe them.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 3 is an enlarged top plan view of one of the key ring mounting parts of the key holder assembly of FIG. 1.

FIG. 4 is a side elevational view of the one key ring mounting part as seen along line 4—4 of FIG. 3.

FIG. 5 is a perspective view of one of the key ring mounting parts of the key holder assembly in unassembled condition.

DETAILED DESCRIPTION OF THE INVENTION

Figure 1:
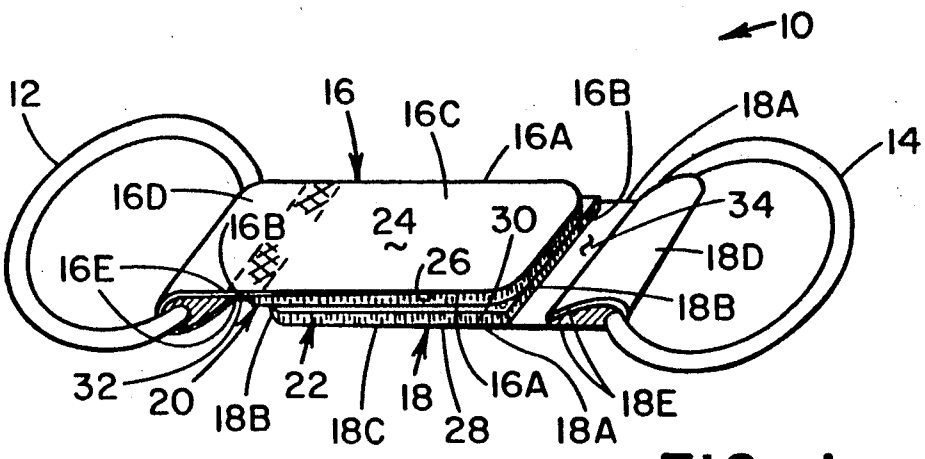
FIG. 1 is a perspective view of a key holder assembly of the present invention with its pair of key ring mounting parts illustrated in attached condition.
Figure 2:
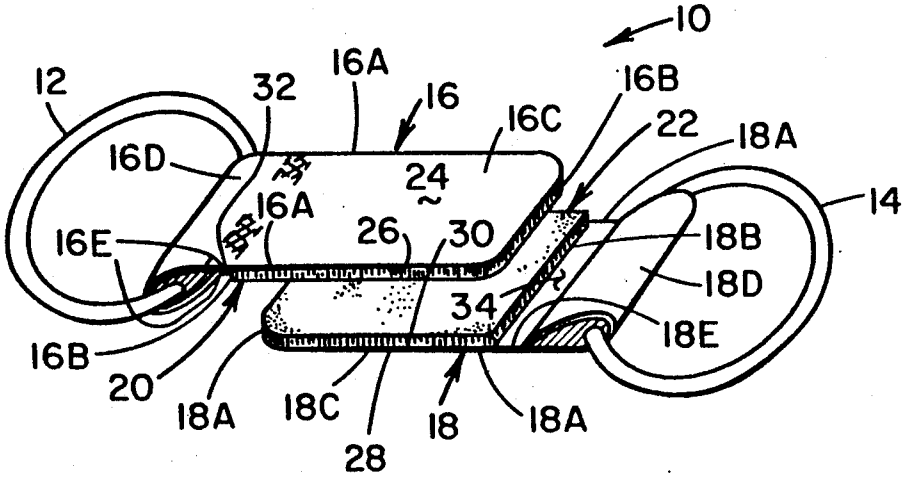
FIG. 2 is a perspective view of the key holder assembly of FIG. 2 with its pair of key ring mounting parts illustrated in detached condition.

Referring to the drawings, and particularly to FIGS. 1 and 2, there is illustrated a key holder assembly of the present invention, being generally designated 10, adapted to hold separate collections of keys (not shown) at its opposite ends. Basically, the key holder assembly 10 includes a pair of key-holding elements 12, 14, a pair of elongated mounting straps 16, 18, and a pair of patches 20, 22 of complementary hook and loop fastening materials, commonly known as velcro (a trademark owned by Velcro U.S.A., Inc.), applied on the straps 16, 18. Preferably, each key-holding element 12, 14 is a conventional split metal ring with respect to which keys (not shown) can be installed and removed in a known manner. Other configurations and types of key-holding elements 12, 14 can be employed within the purview of the present invention.

Referring now to FIGS. 1-5, each of the respective straps 16, 18 has a pair of opposite surfaces 24, 26 and 28, 30 with longitudinal side edges 16A, 18A and a pair of transverse end edges 16B, 18B bordering the surfaces. Each strap 16, 18 is preferably of composed of a flexible material, such as a suitable plastic, and has an elongated rectangular shape, although other geometric shapes can be employed within the purview of the present invention.

Each strap 16, 18 has a main portion 16C, 18C and an end portion 16D, 18D. The end portion 16D, 18D of the strap 16, 18 is folded around one of the key-holding elements 12, 14 and back upon itself so as to provide overlapped sections 16E, 18E. The overlapped sections 16E, 18E of each strap 16, 18 contain a sealed zone 32, 34 extending transversely between the side edges 16A, 18A in which the overlapped sections 16E, 18E are permanently sealed or attached to one another. The zones 32, 34 are preferably of rectangular configuration. The folded-back end portion 16D, 18D of each strap 16, 18 is preferably heat sealed to itself at the zone 32, 34 in the overlapped sections 16E, 18E, although other manners of attaching, such as by stitching, can be employed within the purview of the present invention.

The patches 20, 22 of complementary hook and loop fastening materials are detachably attachable to one another. Each patch 20, 22 extends over substantially the entire length and width of one 24, 28 of the opposite surfaces of the straps 16, 18 between the side edges and end edges thereof. The end portions 16D, 18D of the straps 16, 18, by being folded back upon themselves, cover over the portions of the patches 20, 22 mounted on the end portions 16D, 18D, whereas the portions of the patches 20, 22 left on the non-overlapped main portions 16C, 18C of the straps 16, 18 remain exposed for attachment to one another.

In order to detach and separate the attached straps 16, 18 of FIG. 1 from one another, opposing pulling forces must be applied by a user to the two mounting straps 16, 18 so as to cause peeling of them away from one another.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A key holder assembly, comprising:
(a) a pair of key-holding elements;
(b) a pair of mounting straps each having opposite surfaces; and
(c) a pair of patches of complementary hook and loop fastening materials detachably attachable together and being applied on one of said surfaces of said respective straps over substantially the entire length and width of said straps;
(d) each of said straps having a main portion and an end portion, said end portion being folded around one of said key-holding elements and back upon itself so as to provide overlapped sections in which an end portion of said patch on said strap is covered over whereas the remaining portion of said patch on the remaining nonoverlapped main portion of said strap is exposed for attachment;
(e) said overlapped sections of each strap end portion containing a zone in which said overlapped sections are permanently sealed to one another.

2. The assembly of claim 1 wherein each of said straps has a pair of longitudinal extending side edges and a pair of transversely extending end edges bordering said opposite surfaces of said strap.

3. The assembly of claim 2 wherein said zone contained in said overlapped sections of said strap extends in transverse relation between said side edges.

4. The assembly of claim 1 wherein said folded-back end portion of said strap at said zone in said overlapped sections thereof is heat sealed to itself.

5. The assembly of claim 1 wherein each of said key-holding elements is a split key ring.

6. The assembly of claim 1 wherein each of said mounting straps has a rectangular shape.

7. A key holder assembly, comprising:
(a) a pair of key-holding elements;
(b) a pair of elongated mounting straps, each strap having a pair of opposite surfaces with a pair of longitudinal extending side edges and a pair of transversely extending end edges bordering said surfaces, each strap having an end portion adjacent to one of said end edges being folded around one of said key-holding elements and back upon itself so as to provide overlapped sections, said overlapped strap sections containing a sealed zone extending transverse between said side edges in which said overlapped sections are permanently sealed to one another; and
(c) a pair of patches of complementary hook and loop fastening materials detachably attachable together and being applied on one of said opposite surfaces of said respective straps, each of said patches extending over substantially the entire length and width of said one opposite surface of a respective one of said straps between said longitudinal side edges and said end edges of said one strap such that to detach said straps from one another opposing pulling forces are applied to said two mounting straps to cause peeling of said mounting straps away from one another.

8. The assembly of claim 7 wherein each of said straps has a main portion and said end portion, said end portion in being folded back upon itself so as to provide said overlapped sections covers over the portion of said patch on said end portion of said strap whereas the remaining portion of said patch on the remaining nonoverlapped main portion of said strap is exposed for attachment.

9. The assembly of claim 7 wherein said folded-back end portion of said strap at said zone in said overlapped sections thereof is heat sealed to itself.

10. The assembly of claim 7 wherein each of said key-holding elements is a split key ring.

11. The assembly of claim 7 wherein each of said mounting straps has a rectangular shape.

* * * * *